United States Patent [19]

Pease

[11] 4,271,749

[45] Jun. 9, 1981

[54] REDUCED BACK PRESSURE, ANTI-CAVITATION VALVE SYSTEM

[75] Inventor: George E. Pease, Kent, Wash.

[73] Assignee: The Boeing Company, Seattle, Wash.

[21] Appl. No.: 971,792

[22] Filed: Dec. 21, 1978

[51] Int. Cl.[3] ..... F15B 13/16; F15B 11/10

[52] U.S. Cl. ..... 91/358 R; 91/388; 91/433

[58] Field of Search ..... 91/433, 468, 388, 358 R, 91/358 A, 318

[56] References Cited

U.S. PATENT DOCUMENTS

| | | | |
|---|---|---|---|
| 2,009,608 | 7/1935 | Douglas | 91/433 |
| 2,439,325 | 4/1948 | Wiesendanger | 91/433 |
| 3,628,421 | 12/1971 | George | 91/388 |
| 3,859,791 | 1/1975 | Allen et al. | 91/433 |
| 4,111,283 | 9/1978 | Hastings, Jr. | 91/433 |

FOREIGN PATENT DOCUMENTS

| | | | |
|---|---|---|---|
| 883014 | 11/1961 | United Kingdom | 91/433 |

*Primary Examiner*—Paul E. Maslousky

*Attorney, Agent, or Firm*—Christensen, O'Connor, Johnson & Kindness

[57] ABSTRACT

A valving system for regulating the pressure of the fluid within a hydraulic actuator of the type having a hydraulic cylinder and movable piston therein that separates the cylinder into a first and second chamber comprises sensing apparatus in fluid communication with the first chamber of the hydraulic actuator cylinder. The sensing apparatus senses the differences in pressure between the fluid within the first chamber and the fluid in the second chamber. The valving system further includes a pressure regulator for regulating the pressure within the first chamber in response to the sensed pressure difference. Apparatus is also included for communicating the magnitude of the sensed pressure difference to the pressure regulator.

5 Claims, 1 Drawing Figure

REDUCED BACK PRESSURE, ANTI-CAVITATION VALVE SYSTEM

BACKGROUND OF THE INVENTION

This invention relates to hydraulic control systems and more particularly relates to a valve system for reducing back pressure and preventing cavitation in a hydraulic actuator or motor caused by the influence of external forces on the actuator or motor.

Many hydraulic systems are used for the actuation of equipment involving both resisting and assisting loads during each half cycle of actuation. The actuation is also at a regulated speed and is limited at one end by physical stops. The specific actuation problem for which the valve system of the present invention was developed was the deployment of the leading edge devices on the wing of an aircraft, however it is equally applicable to hydraulic systems employed in earth moving vehicles and the like using double acting hydraulic jacks for adjusting various machine components and implements carried on such vehicles, for example the bucket of a front loader or the body of a dump truck.

In the environments mentioned above during the initial portion of the working stroke, the hydraulic actuator or motor works against the weight of the load which it is moving. However, at some point in the cycle the center of gravity of the load passes over the pivot axis thereof and for the remainder of the stroke the load is assisting, that is, the load tends to move the actuator in the same direction as the driving fluid supplied to the actuator. In order to maintain a constant speed of actuation, it has in the past been necessary to place a flow limiter in the outlet flow path from the hydraulic actuator cylinder to maintain a constant outflow of fluid from the cylinder. In most circumstances, however, it is undesirable to substantially restrict the flow of fluid to or from the actuator since such restriction causes the undesirable generation of heat and the build up of back pressure in the system which consumes energy that could be more beneficially used to perform other work functions desired of the system. However, if the load is allowed to move the actuator more rapidly than the design speed of the system, the inlet fluid pressure to the actuator can be reduced to a negative amount due to the load causing the actuator to move faster than the system can supply fluid to it. The negative pressure on the inlet side of the actuator may cause cavitation along the surface of the actuator piston which can cause severe damage to the components of the system. Other problems are presented by the use of a flow limiter in the outflow line to substantially limit the flow of fluid in the outlet side of the actuator during the movement of an assisting load. The back pressure on the outflow side of the actuator with the assisting load will be the sum of the pressure required to maintain the desired rate of motion plus full system pressure due to the fluid inletting to the inlet side of the actuator. Under many load levels this sum of pressures would easily exceed the maximum system pressure thereby requiring special hydraulic hardware. The excess back pressure can be avoided by applying return pressure to the inflow side of the actuator during assisting loads. This would, however, involve additional load sensing equipment, valving and other apparatus and would increase the complexity of the hydraulic system. Also, when the hydraulic system is being used to control the aerodynamic surfaces of an aircraft the addition of apparatus adds to the weight of the hydraulic system and therefore the total weight of the aircraft. Also the application of return pressure to the inlet side of the actuator would not necessarily solve the cavitation problems, since at return pressure the inflow could still cavitate causing actuator or motor difficulties.

Finally, with the conventional approach outlined above at the end of the actuation, the actuator would be positioned in the physical stops and would be loaded with full system pressure on the inlet side of the actuator cylinder placing a strain on the system and requiring the physical stops to be constructed so as to be sufficient to withstand the full system pressure, plus the weight of the load if the load is assisting, rather than some lower pressure which would allow a lighter construction of the physical stops.

It is therefore an object of the present invention to provide a valving system for use with a hydraulic actuator or motor that would minimize back pressure generated by a metered outflow regulating device under load conditions that vary from maximum resisting to maximum assisting during one-half cycle of operation of the actuator.

It is a further object of this invention to provide such a valving system that will prevent cavitation of the actuator or motor during extension of the actuator at a maximum rate with an assisting load.

It is another object of this invention to provide such a valving system that will provide a controlled predetermined level of load on the physical stops when the actuator reaches the end of its travel.

A further object of this invention is to provide such a valving system that is of simple construction and relatively inexpensive to construct and install.

BRIEF SUMMARY OF THE INVENTION

In accordance with the foregoing objects, an improved valving system is provided for regulating the pressure of the fluid within a hydraulic actuator of the type having at least first and second fluid sealed chambers therein wherein the operation of the actuator is the result of the existence of a difference in the pressures within said first and second chambers. The improved valving system of the present invention includes sensing means in fluid communication with said first and second chambers for sensing the difference between the pressures within the chambers. A pressure regulating means is in fluid communication with one of the chambers and regulates the pressure within that chamber in response to the sensed difference in pressure. A communicating means is included for communicating the sensed pressure difference from the sensing means to the pressure regulating means.

In a preferred embodiment of the valving system the actuator is of the type having a hydraulic cylinder and a movable piston therein that separates the cylinder into a first and second chamber. The sensing means is in fluid communication with the first and second chambers of the hydraulic actuator cylinder and senses the difference in fluid pressure between the first and second chambers. The valving system further includes a pressure regulating means, in fluid communication with the first chamber of the hydraulic actuator cylinder, for regulating the pressure of the fluid in said first chamber in response to the sensed difference in pressure between the first and second chambers. Means are also included for communicating the sensed difference in pressure from the sensing means to the pressure regulating means.

In one embodiment of the valving system of the present invention, the sensing means includes a hydraulic sensing cylinder having a movable piston therein that separates the sensing cylinder into a first and second chamber, the first chamber of the sensing cylinder being in fluid communication with the first chamber of the hydraulic actuator cylinder and the second chamber of the sensing cylinder being in fluid communication with the second chamber of the hydraulic actuator cylinder.

BRIEF DESCRIPTION OF THE DRAWINGS

A better understanding of the features and advantages of this invention will be achieved after reading the ensuing specification with reference to the drawings wherein.

DETAILED DESCRIPTION OF THE PREFERRED EMBODIMENT

Figure 1:
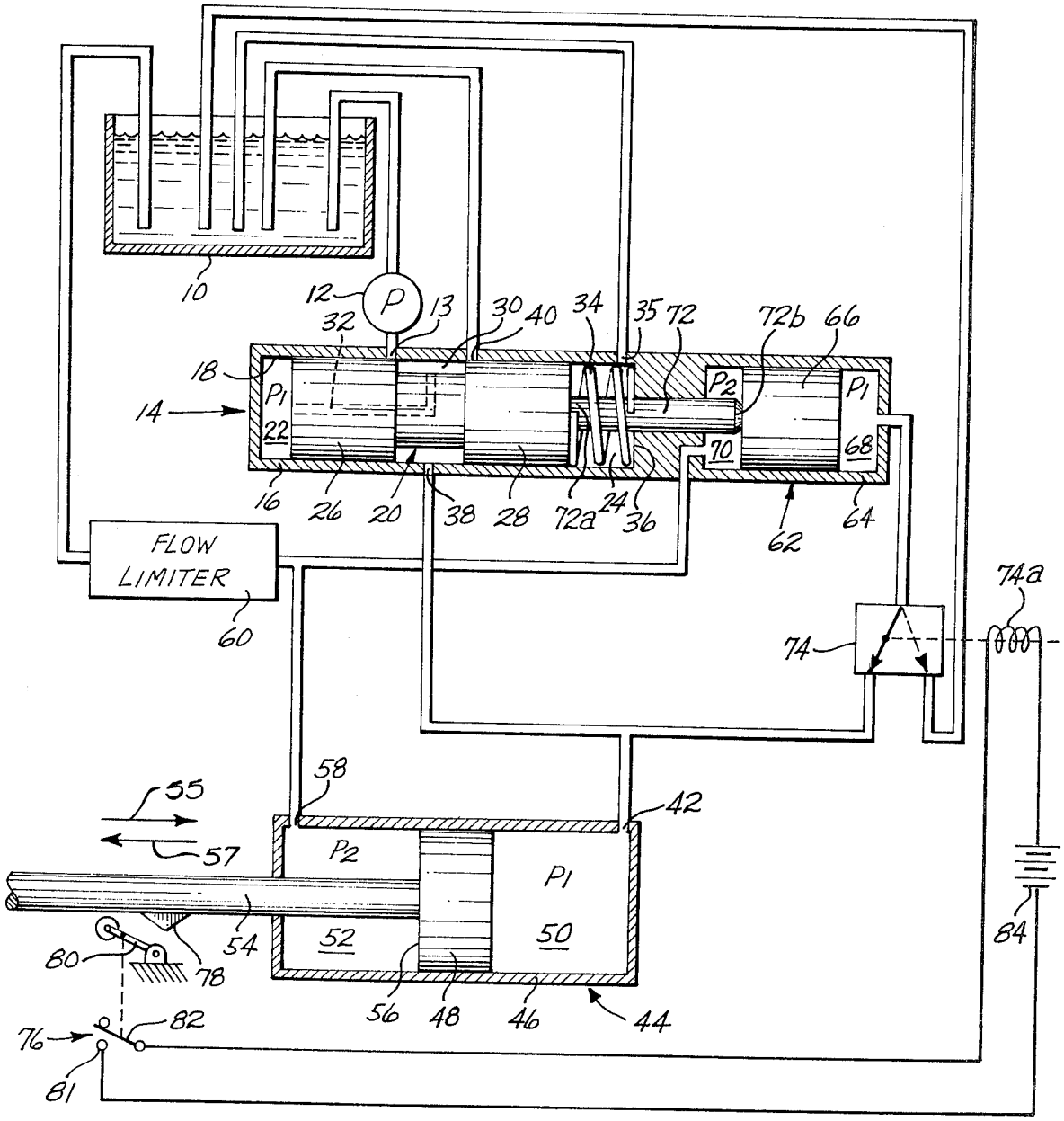
FIG. 1 is a schematic representation of the valving system of the present invention in use with a hydraulic actuator.

Referring now to FIG. 1, an improved valving system made in accordance with the principles of the present invention includes a fluid reservoir 10 from which fluid is pumped by means of a conventional pump 12 and transferred to an inlet port 13 of a pressure regulator 14. The pressure regulator 14 includes a valve body 16 having a central valve bore 18 and a valve spool 20 slidably positioned within the valve bore 18. When the valve spool is centrally positioned within the valve bore, a first chamber 22 is formed at a first end of the valve bore (the left of the pressure regulator 14 as viewed in FIG. 1) and a second chamber 24 is formed at a second end of the pressure regulator (the right end as viewed in FIG. 1). The valve spool 20 has first and second lands, 26 and 28, respectively, formed thereon. The first land 26 being adjacent the first chamber 22 and the second land 28 being adjacent the second chamber 24. The first and second lands are of a diameter slightly less then the diameter of the valve bore 18. The portion of the valve spool 20 intermediate the lands is smaller in diameter than the lands and an annular chamber 30 exists between the intermediate portion of the valve spool 20 and the walls of the valve bore 18. A suitable fluid seal is affixed to the first and second lands so that there is no fluid communication between the first chamber 22, second chamber 24 and the annular chamber 30 by way of the outer surface of the lands.

A channel 32 is formed through the valve spool beginning in the outer surface of the intermediate portion and terminating in the face of the first land 26 adjacent the first chamber 22. The channel 32 provides a path for fluid between the annular chamber 30 and the first chamber 22.

The pressure regulator 14 has an outlet port 38 formed in the valve body 16 adjacent and in fluid communication with the annular chamber 30. A relief port 40 is formed in the valve body in fluid communication with the annular chamber 30, said communication being interruptable by movement of the valve spool that causes the second land 28 to block the relief port 40 as discussed below. A coil spring 34 is positioned within the second chamber 24 of the regulator 14, one end of the spring 34 abuts an end wall 36 of the valve bore 18 and the other end of the spring 34 abuts the second land 28 of the valve spool 20.

The pressure regulator 14 is of the type known as a null-seeking valve. The spring 34 is installed with a compression preload such that when the valve spool 20 is in the neutral or null position the pressure of the fluid within the first chamber 22 equals the pressure of the fluid within the central annular chamber 30 and is at the level, chosen as the minimum pressure with an assisting load. The minimum pressure level is determined by the compressive force of the spring 34 and will be discussed in greater detail below. If the pressure within the first chamber 22 is lower than the minimum desired pressure as determined by the spring 34, the force of the spring 34 will move the valve spool to the left and the first land 26 will be to the left of the inlet port 13 thereby allowing fluid to enter the annular chamber 30. In this state, the second land 28 blocks the relief port 40. The fluid flows through the annular chamber 30 and leaves the regulator through the outlet port 38. Fluid also flows through channel 32 into the first chamber 22. If the pressure within the first chamber 22 becomes great enough to exert a force on the left end of the valve spool 20 that is greater than the compression force of the spring 34, the valve spool 20 will move to the right causing the first land 26 to block the inlet port 13 thereby preventing the entry of fluid into the regulator 14. At the same time, the second land 28 is moved from its position blocking the relief port 40 thereby allowing fluid to exit the regulator through the relief port 40. The relief port 40 is connected through suitable piping to the reservoir 10 and the pressure within the annular chamber 30 and the first chamber 22 is reduced by the flow of fluid back to the reservoir 10. When the pressure has dropped below the predetermined minimum pressure the spring 34 will force the valve spool 20 to the left thereby blocking the relief port 40 and opening the inlet port 13 to allow fluid to once again enter the pressure regulator 14.

A vent port 35 in the wall of the second chamber 24 is coupled by suitable conduit to the reservoir 10. Therefore, free flow of fluid occurs into and out of the second chamber so that no pressure is built up in the second chamber due to compression of fluid within the second chamber when the valve spool 20 moves.

The outlet port 38 of the pressure regulator 14 is connected by suitable piping to an inlet port 42 of a hydraulic actuator 44. The hydraulic actuator 44 is of the type having a hydraulic cylinder 46 and a movable piston 48 sealably contained within the hydraulic cylinder 46. The piston 48 separates the cylinder into a first chamber 50 and a second chamber 52. A suitable seal is installed around the periphery of the piston 48, so that a fluid tight seal is maintained between the piston 48 and the walls of the cylinder 46, thereby fluidly isolating the first and second chambers 50 and 52, respectively. A contractible and extensible rod 54 is fixed to a first face 56 of the piston 48 adjacent the second chamber 52. The rod 54 extends through the end wall of the second chamber 52 and terminates at a load (not shown). The load could be any of several typical loads such as a bucket of a power shovel or backloader, the blade of a bulldozer or in the specific case for which this valving system was designed, a leading edge device on the wing of an aircraft. The second chamber 52 has an outlet port 58 formed in its wall. The outlet port 58 is coupled in fluid communication with a flow limiter 60 that maintains the output flow from the second chamber at a constant rate thereby maintaining the speed of motion of the piston within the hydraulic cylinder 46 at a constant speed. The flow limiter 60 can be any conventional pressure compensated flow control device that automatically adjusts to pressure changes thereby maintaining a constant pressure drop from inlet to outlet and a constant flow through the flow limiter. Once the fluid has passed through the flow limiter 60, it is routed through suitable piping to the reservoir 10.

The valving system further includes a sensing means 62 comprising a hydraulic sensing cylinder 64 having a movable piston 66 therein, the piston 66 separating the cylinder 64 into a first chamber 68 and a second chamber 70, the piston being sealed within the cylinder so as to maintain fluid isolation between the first and second chambers. The first chamber 68 of the sensing cylinder 64 is coupled in fluid communication with the first chamber 50 of the hydraulic actuator 44, and the second chamber 70 of the sensing cylinder 64 is coupled in fluid communication with the second chamber 52 of the hydraulic actuator 44. The sensing cylinder 64 in the illustrated embodiment is integrally formed with the valve body 16 of the pressure regulator 14, however, the sensing cylinder could be a completely separate physical unit and still function in the desired manner.

A first end 72*a* of communicating rod 72 is affixed to or abuts the second land 28 of the valve spool 20 within the pressure regulator 14. The communicating rod 72 extends through the end wall of the second chamber 24 of the pressure regulator 14 and through the end wall of the second chamber 70 of the sensing cylinder 64, and terminates within the second chamber 70 of the sensing cylinder 64. The second end 72*b* of the communicating rod 72 normally abuts the face of the piston 66 adjacent the second chamber 70 of the sensing cylinder 64. If the pressure within the first chamber 68 of the sensing cylinder 64 is greater than the pressure within the second chamber 70 the piston 66 will be urged to the left. The piston 66 will urge the rod 72 to the left and the rod 72 in turn, will urge the valve spool 20 to the left. As a consequence, the effective pressure to which the pressure regulator 14 will regulate will be governed not only by the spring 34 but by the magnitude of the pressure differential between the chambers 68 and 70 of the sensing cylinder 64.

If on the other hand, the pressure within the first chamber 68 of the sensing cylinder 64 is less than the pressure within the second chamber 70, the piston 66 will be urged to the right. Since the communicating rod 72 is not attached to the piston 66, the communicating rod 72 and the piston 66 will be separated and the sensing means 62 will exert no influence on the valve spool 20. In this situation, the pressure to which the regulator 14 will regulate will be determined solely by the spring 34.

In operation, the pump 12 pumps fluid from the reservoir 10 to the inlet port 13 of the pressure regulator 14. The bias spring 34 positions the valve spool 20 within the pressure regulator 14 such that fluid can enter the pressure regulator 14 through the inlet port 13 and pass into the annular chamber 30. The fluid then leaves the pressure regulator 14 through the outlet port 38 and flows into the first chamber 50 of the hydraulic actuator 44. A load (not shown) is attached to the end of the rod 54. Assuming that the load is such that the force F, illustrated by arrow 55, exerted by the load operates along the rod 54 so as to urge the piston 48 to the right as viewed in FIG. 1, the fluid will flow into the first chamber 50 until the pressure within the first chamber 50 is sufficient to overcome the pressure in the second chamber 52 and exert a force on the piston 48 sufficient to overcome the force exerted by the load. The pressure required within the first chamber 50 in order to overcome the load is designated $P_F$. Since the first and second chambers 68 and 70 of the sensing cylinder 64 are respectively in fluid communication with the first and second chambers 50 and 52 of the hydraulic actuator 44, the pressure within the first and second chambers 68 and 70 of the sensing cylinder 64 is the same as the pressure within the first and second chambers 50 and 52 respectively of the hydraulic actuator 44. As the fluid flows into the pressure regulator 14 it also flows into the channel 32 formed in the valve spool of the pressure regulator, and into the first chamber 22 formed on the left end of the pressure regulator 14 since the first chamber 22 of the pressure regulator 14 and the first chamber 50 of the hydraulic actuator 44 are coupled in fluid communication, the pressure of the fluid within the first chambers of the pressure regulator and hydraulic cylinders respectively must be equal. As the pressure in the first chamber 22 of the pressure regulator 14 increases, the force exerted by the fluid on the first land 26 of the valve spool 20 increases urging the valve spool 20 against the coil spring 34. When the force exerted on the valve spool 20 is sufficient to overcome the spring force and compress the spring 34, the valve spool 20 will move to the right as viewed in FIG. 1.

In the valving system shown in FIG. 1, an additional force in addition to the spring force is provided by the piston 66 within sensing cylinder 64, caused by the difference in pressure between the first and second chambers 68 and 70 of the sensing cylinder 64. The added force is communicated to the valve spool 20 in the pressure regulator 14 by the communicating rod 72 affixed to or abutting the valve spool 20 and now abutting the piston 66 within sensing cylinder 64. Therefore, in order for the valve spool 20 to move to the right, it must not only overcome the force of the coil spring 34 within the second chamber 24 of the pressure regulator 14, but also must overcome the pressure differential and the force exerted thereby within the sensing cylinder 64. When the pressure of the fluid within the first chamber 22 of the pressure regulator 14 is sufficient to exert a force on the valve spool 20 of a magnitude great enough to move the valve spool 20 to the right, the second land 28 of the valve spool 20 moves from its position blocking the relief port 40 of the pressure regulator 14 thereby allowing fluid to flow through the relief port 40 from within the pressure regulator 14 back to the reservoir 10, thus reducing the pressure within the first chamber 22 of the pressure regulator 14 and the first chamber 50 of the hydraulic actuator 44. When enough fluid has been released back to reservoir 10, the pressure within the first chamber 22 of the pressure regulator 14 will be reduced such that the force is no longer sufficient to overcome the spring force and the force transmitted by the communicating rod 72 and maintain the land 28 in its second position. The force exerted by the sensing piston 66 and coil spring 34 will then move the valve spool 20 to the left (as viewed in FIG. 1) causing the second land 28 to block the relief port 40 and the first land 26 to move from its position blocking the inlet port 13 to allow additional fluid from the reservoir 10 to be pumped into the pressure regulator 14. It can be seen therefore by those skilled in the art and others, that the pressure regulator 14 operates to maintain an equilibrium between the pressures within the first and second chambers 22 and 24 of the pressure regulator which in turn maintains an equilibrium in the forces on the right and left hand side of the valve spool 20.

In the case of a resisting load on the rod 54, the load will exert a force F in a direction to the right as viewed in FIG. 1. The pressure that must exist within the first chamber 50 of the hydraulic actuator 44 in order to produce a force on the piston 48 sufficient to overcome the force F and thereby move the load in a direction opposite the application of the force F is designated $P_F$. The actual pressure within the first chamber 50 is designated $P_1$ and the pressure within the second chamber 52 is designated $P_2$. The pressure which is required in the first chamber 22 of the pressure regulator 14 in order to produce a force upon the valve spool 20 equal to the force exerted on the opposite end of the valve spool 20 by the coil spring 34 is designated $P_b$. $P_b$ is therefore equal to the bias pressure of the coil spring 34.

The force produced by the pressure $P_2$ in the second chamber 52 of the hydraulic actuator 44 operates in a direction opposite the force produced by the pressure $P_1$ within the first chamber 50 of the hydraulic actuator 44. In order to move the load on the rod 44 where the load exerts a force F to the right, it is necessary that $P_1$ minus $P_2$ equals $P_F$. Since the first and second chambers 68 and 70 of the sensing cylinder 64 are directly coupled in fluid communication to the first and second chambers 50 and 52 respectively of the hydraulic actuator 44, the pressure differential across the sensing piston 66 will be equal to the pressure differential across the hydraulic actuator piston 48, that is, $P_1$ minus $P_2$. The pressure differential $P_1$ minus $P_2$, so long as $P_1$ is greater than $P_2$, is transmitted from the sensing cylinder piston 66 to the pressure regulator valve spool 20 by means of the communicating rod 72, therefore the pressure on the right hand side of the valve spool 20 is equivalent to $P_1$ minus $P_2$ plus the bias pressure of the spring $P_b$. Therefore: (1) $P_1-P_2+P_B=P_F+P_B$.

The first chamber 22 of the pressure regulator 14 is coupled in fluid communication to the first chamber 50 of the hydraulic actuator 44 and therefore the pressure within the first chamber 22 of the pressure regulator 14 is also equal to $P_1$. Solving equation 1 for $P_1$: (2) $P_1=P_F+P_2$.

Because of the operation of the pressure regulator 14 as described above, the pressure in the right and left chambers 22 and 24 of the pressure regulator 14 are maintained in equilibrium by the movement of the valve spool 20 opening and closing the inlet port 13 and relief port 40 of the pressure regulator 14. Therefore, the pressure in the left hand chamber 22 is equal to $P_F$ plus $P_2$ which is equal to the pressure in the right hand chamber 24 which is equal to $P_F$ plus $P_b$. Subtracting $P_F$ from each side of the equation yields the result: (2) $P_2=P_b$.

Substituting this into the first equation and solving for $P_1$: (3) $P_1=P_F+P_b$.

Therefore, whenever the hydraulic actuator 44 is working to overcome a resisting load, the pressure $P_2$ in the second chamber 52 is maintained at a pressure equal to the bias pressure $P_b$ of the spring 34, which can be preset to any desired magnitude thereby eliminating the problem of excessive back pressures in the second chamber 52.

In the case where the force exerted by the load on the rod 54 is assisting the movement of the piston 48, that is, the force, illustrated by arrow 57, is exerted in a direction to the left as viewed in FIG. 1, the fluid within the second chamber 52 will resist the movement of the piston 48. The pressure $P_1$ in the first chamber 50, in this case, will be less than the pressure $P_2$ in the second chamber 52. The pressure differential $P_2$ minus $P_1$ again will be equal to $P_F$ so as to maintain the movement of the piston 48 at some predetermined rate set by the flow of fluid through the flow limiter 60 so that the piston 48 does not move freely and exceed the rate desired. (4) $P_2-P_1=P_F$.

In the case of an assisting load since the pressure $P_2$ is greater than the pressure $P_1$, the piston 66 within the sensing cylinder 64 will move to the right as viewed in FIG. 1. Since the communicating rod 72 is not affixed to the piston 66, the communicating rod 72 will remain stationary and no pressure will be exerted by the sensing piston 66 on the valve spool 20 within pressure regulator 14. Therefore the pressure on the right side of the pressure regulator 14 will be equal to $P_b$, the bias pressure of the coil spring 34. Due to the equalizing action of the pressure regulator 14, the pressure on the left side must equal the pressure on the right side. Therefore the pressure on the left side which is also equal to $P_1$, is equal to $P_b$, the bias pressure of the coil spring. Inserting this into equation 4 and solving for $P_2$:

(5) $P_2=P_F+P_1$ $P_2=P_F+P_b$.

Therefore with an assisting load the pressure $P_2$ will equal $P_F$, plus $P_b$ where $P_b$ is some known pressure chosen by the designer. Without this regulation and with an assisting load, $P_2$ would equal maximum system pressure exerted by fluid within the first chamber 50 plus whatever additional pressure would be needed to resist the assisting load which would be $P_F$. The flow regulator heat loss would then be based on this higher than maximum system pressure and the piping would have to be designed around that pressure. With the valve system of the present invention, pressure $P_2$ is equal to $P_F$ plus some smaller increment $P_B$, a smaller than maximum system pressure, thereby eliminating the need for designing the piping around the excessively high pressures.

In addition to limiting the maximum pressure which will be maintained within the second chamber 52 of the hydraulic actuator 44, the valving system of the present invention also acts to prevent cavitation within the first chamber 50 when an assisting load is handled by the actuator 44. Since, as described above, when the actuator 44 is used to move an assisting load, the pressure $P_1$ within the first chamber 50 is reduced to the bias pressure of the spring $P_b$, cavitation can be prevented merely by choosing the coil spring such that the pressure $P_b$ is sufficient to prevent cavitation under all conditions.

In the illustrated embodiment of the valving system of the present invention, means are also provided for limiting the pressure within the first chamber 50 and thereby the force exerted on the piston 48 once the load has moved to its desired position and the rod 54 has extended to its physical limit. An automatic valve 74, such as a solenoid actuated valve, is placed in the fluid path between the first chamber 50 of the hydraulic actuator 44 and the first chamber 68 of the sensing cylinder 64. In normal operation the valve 74 allows communication between the respective first chambers 50 and 68. A limit switch 76 is mounted in operative relationship to the rod 54. The limit switch 76 is open when the rod 54 is in its contracted position, however when the rod extends to a predetermined location (its limit), the switch 76 closes and the solenoid valve 74 is activated and shifts position such that the communication between the respective first chambers 50 and 68 is terminated and the first chamber 68 of the sensing cylinder 64 is now connected directly to the reservoir 10. A protruding member 78 is affixed to the rod 54. As the rod 54 reaches the end of its travel the protruding member 78 contacts a wiper arm 80, moving the wiper arm 80 which in turn, closes the switch contacts 81 and 82 of the limit switch 76 thereby completing the circuit between the solenoid coil 74*a* and the electrical source 84. The coil 74*a* is activated and causes the valve 74 to shift position. The fluid from the first chamber 68 of the sensing cylinder 64 must now flow directly to the reservoir 10, therefore, the pressure in the first chamber 68 of the sensing cylinder 64 is effectively reduced to atmospheric pressure or whatever other pressure is available within the reservoir 10. The pressure $P_2$ within the second chamber 70 of the sensing cylinder 64 then exerts a force upon the piston 66 moving the piston 66 to the right and separating the piston 66 and the communicating rod 72. The pressure regulator 14 will then regulate the fluid within the first chamber 50 of the hydraulic actuator 44 to $P_b$, the bias pressure of the coil spring 34 within the pressure regulator 14. The pressure exerted on the piston 48 by the fluid within the first chamber 50 will then remain at $P_b$ during the entire time that the limit switch 76 is closed. In the prior art systems that did not incorporate all the features of the valving system of the present invention, the pressure in $P_1$ would be regulated to maximum system pressure while the rod 54 was at its limit necessitating the design of stops for rod 54 to be able to withstand the full system pressure. With the valving system of the present invention, the limit stops can be lighter since it is only necessary that the limit stops be able to withstand the force exerted by the fluid under a pressure of $P_b$ which is less than maximum system pressure. It will be noted that it is also necessary for the stops to support the force F exerted by the load upon the rod 54 if the load is an assisting load as defined above.

It will be apparent to those skilled in the art and others that the valving system described and illustrated will function only to move the piston 48 in one direction, to the left as viewed in FIG. 1, within the actuator 44. The valving system can be modified by additional valves and piping to reroute the fluid path to allow the piston 48 to move to the right by bleeding off the fluid from the first chamber 50 back to the reservoir 10. The additional valves and piping necessary are well known in the art and are unrelated to the invention described herein. They have been omitted for the sake of clarity. Also, an additional regulator and sensing means can be included to provide for movement of the piston 48 to the right with a load.

In summary, therefore, a valving system for use with a hydraulic actuator of the type having a movable piston within a hydraulic cylinder, the piston separating the cylinder into first and second chamber, is disclosed. The valving system regulates pressure within the hydraulic cylinder chambers by sensing the pressure difference between the first and second chambers of the hydraulic actuator and communicating the sensed pressure difference to a pressure regulator. The pressure regulator in turn varies the pressure within the first chamber of the hydraulic cylinder in response to the sensed pressure difference. A limit switch and automatic valve means are also included for determining when the hydraulic actuator has reached its limit of extension so as to reduce the pressure exerted by the fluid within the hydraulic actuator during the time that the actuator is extended to its limit, thereby enabling the limit stops to be lighter than they could with the prior art valving systems now in existence.

It will be appreciated by those skilled in the art and others that various changes can be made to the valving system described above while remaining within the scope of the invention. For example, although a solenoid type of valve is illustrated and described for use in the system, any automatic valve which operates in response to an actuator reaching its limit can be used. Further, although the invention has been described in the environment of a hydraulic actuator, having a linearly movable piston, it is also possible to use the valving system of the present invention with other types of hydraulic actuators and hydraulic motors in which the operation of the actuator or motor is a result of a pressure differential between two chambers of the actuator. Therefore while a specific embodiment of the invention has been described, variations in structural detail are possible and are contemplated. There is no intention therefore of limitation to the exact details shown and described.

The embodiments of the invention in which an exclusive property or privilege is claimed are as follows:

1. An improved valving system for regulating the pressure of the fluid within a hydraulic actuator of the type having a first hydraulic cylinder, a movable piston therein that separates the cylinder into first and second actuator chambers, said improved valving system comprising:

sensing means in fluid communication with said first and second actuator chambers for sensing the difference in fluid pressure of the fluid within said first and second actuator chambers, said sensing means including a second hydraulic cylinder having a sensing piston movably mounted therein that separates said second cylinder into first and second sensing chambers, said first sensing chamber being in fluid communication with said first actuator chamber and said second sensing chamber being in fluid communication with said second actuator chamber;

pressure regulating means in fluid communication with said first actuator chamber for regulating the pressure of the fluid within said first actuator chamber in response to said sensed difference in pressure;

means for transmitting said difference in pressure from said sensing means to said pressure regulating means;

signal producing means operably associated with said actuator for producing a first signal in response to said piston within said first hydraulic cylinder reaching a predetermined location within said first hydraulic cylinder; and, valve means responsive to said first signal for interrupting the fluid communication between said first sensing chamber and said first actuator chamber.

2. The valving system of claim 1 wherein said pressure regulating means includes a valve body having a central bore formed therein, a valve spool within said bore linearly movable within said bore, said valve spool having at least first and second lands thereon, said valve body further including an inlet port, an outlet port and a relief port, said valve spool being positioned within said bore so that a first chamber is formed adjacent said first land, a second chamber is formed adjacent said second land, said regulating means further including bias means associated with said second chamber and said second land said biasing means acting to maintain the position of said valve spool within said bore such that said first land blocks said relief port;

said transmitting means comprising a rigid rod having a first and second end, the first end abutting said second land, said rod extending into said second sensing chamber and terminating in a second end, said second end of said rod abutting said sensing piston when the pressure within said first sensing chamber is greater than the pressure within said second sensing chamber.

3. The improved valving system of claim 2 wherein said second hydraulic cylinder and said valve body of said pressure regulating means are integrally formed with one another.

4. The valving system of claim 1 wherein said actuator includes a load bearing rod affixed to said piston within said first hydraulic cylinder said signal producing means including a limit switch operably associated with said load bearing rod, said valve means including a solenoid actuated valve electrically coupled to said limit switch.

5. An improved valving system for regulating the pressure of fluid within a hydraulic actuator of the type having a first hydraulic cylinder and a movable piston therein that separates the cylinder into first and second actuator chambers, said improved valving system comprising:

sensing means in fluid communication with said first and second actuator chambers for sensing the difference in fluid pressure of the fluid within said first and second actuator chambers, said sensing means including a second hydraulic cylinder having a sensing piston movably mounted therein that separates said second cylinder into first and second sensing chambers, said first sensing chamber being in fluid communication with said first actuator chamber and said second sensing chamber being in fluid communication with said second actuator chamber;

pressure regulating means in fluid communication with said first actuator chamber for regulating the pressure of the fluid within said first actuator chamber in response to said sensed pressure difference, said pressure regulating means including a valve body having a central bore formed therein, a valve spool within said bore linearly movable within said bore, said valve spool having at least first and second lands thereon, said valve body further including an inlet port, an outlet port and a relief port, said valve spool being positioned within said bore so that a first chamber is formed adjacent said first land, a second chamber is formed adjacent said second land, said regulating means further including biasing means associated with said second chamber and said second land, said biasing means acting to maintain the position of said valve spool within said bore such that said first land blocks said relief port; and means for transmitting said difference in pressure from said sensing means to said pressure regulating means, said transmitting means including a rigid rod having a first and a second end, said first end abutting said second land, said rod extending into said second sensing chamber and terminating in a second end, said second end of said rod abutting said sensing piston when the pressure within said first sensing chamber is greater than the pressure within said second sensing chamber.

* * * * *